US007896305B2

(12) United States Patent
Lowenstein, Jr.

(10) Patent No.: US 7,896,305 B2
(45) Date of Patent: Mar. 1, 2011

(54) APPLIANCE STABILIZING DEVICE WITH QUICK RELEASE ATTACHMENT

(76) Inventor: Arnold G. Lowenstein, Jr., Hayward, CA (US)

( * ) Notice: Subject to any disclaimer, the term of this patent is extended or adjusted under 35 U.S.C. 154(b) by 745 days.

(21) Appl. No.: 11/711,447

(22) Filed: Feb. 26, 2007

(65) Prior Publication Data

US 2007/0164190 A1 Jul. 19, 2007

Related U.S. Application Data

(63) Continuation-in-part of application No. 10/954,938, filed on Sep. 30, 2004, now Pat. No. 7,185,872, which is a continuation-in-part of application No. 10/389,029, filed on Mar. 17, 2003, now abandoned.

(51) Int. Cl.
*A47G 1/16* (2006.01)

(52) U.S. Cl. ..... 248/500; 248/680; 248/681

(58) Field of Classification Search ..... 248/500, 248/499, 680, 681
See application file for complete search history.

(56) References Cited

U.S. PATENT DOCUMENTS

| | | | | |
|---|---|---|---|---|
| 545,098 | A | 8/1895 | Schloss | 312/101 |
| 3,993,027 | A | 11/1976 | Mullin | 119/29 |
| 4,754,948 | A | 7/1988 | Casciani et al. | 248/680 |
| 4,890,813 | A | 1/1990 | Johnson et al. | 248/680 |
| 4,967,993 | A | 11/1990 | Wilson et al. | 248/475.1 |
| 5,076,525 | A | 12/1991 | Whipple et al. | 248/300 |
| 5,516,067 | A | 5/1996 | Schiele et al. | 248/220.21 |
| 6,533,238 | B2 | 3/2003 | Barnes et al. | 248/680 |
| D512,903 | S | 12/2005 | Gallien | D8/349 |

FOREIGN PATENT DOCUMENTS

| | | |
|---|---|---|
| CA | 2312680 | 12/2000 |

*Primary Examiner* — Ramon O Ramirez
(74) *Attorney, Agent, or Firm* — Shirley L. Church, Esq

(57) ABSTRACT

An appliance stabilizing device which is useful in securing an appliance in position against a supporting structure surface. The device includes a plurality of brackets which are selectively positionable on an appliance, with a plurality of elongated members, each pivotally attached to a bracket. Each elongated member has at least one aperture spaced a distance along the length of the elongated member from the pivotal point with the bracket. The elongated member is attached to a support surface, frequently a bottom plate or sole pate of the wall. The bracket includes apertures spaced from each other in a generally triangular configuration or a configuration of equivalent strength. The elongated member is typically pivotally attached at the apex of a generally triangular configuration of apertures. The device is self adjusting during attachment of the appliance to a supporting structure. An advantageous embodiment includes a quick-release mechanism at the pivotal attachment between the brackets and the first ends of the elongate members.

17 Claims, 8 Drawing Sheets

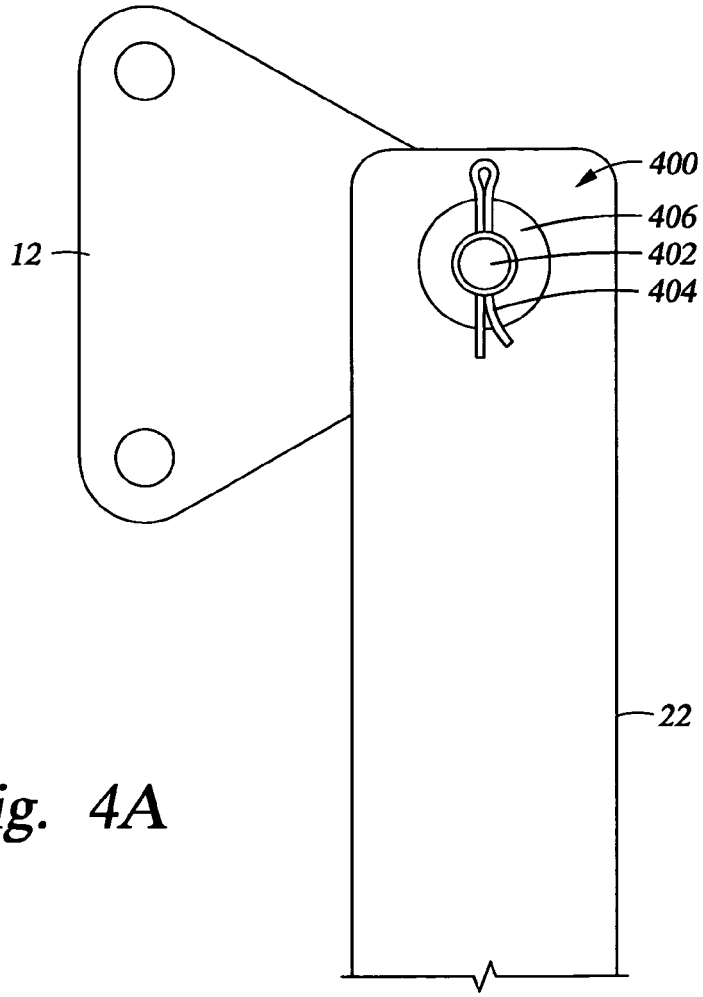
Fig. 4A
Fig. 4B
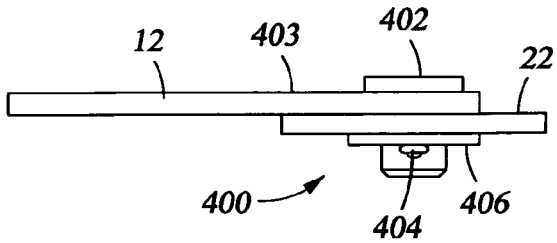
Fig. 4C
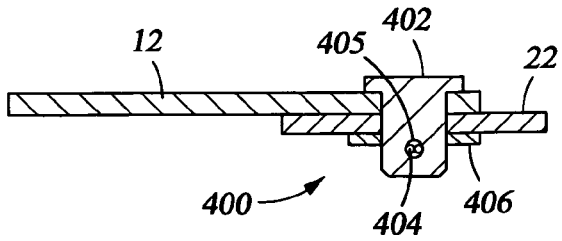

APPLIANCE STABILIZING DEVICE WITH QUICK RELEASE ATTACHMENT

The present application is a continuation-in-part of application Ser. No. 10/954,938 filed Sep. 30, 2004, titled: "Appliance Stabilizing Device", which issued as U.S. Pat. No. 7,185,872 on Mar. 6, 2007, which is a continuation-in-part application of Ser. No. 10/389,029, filed Mar 17, 2003, titled: "Appliance Stabilizing Device", which was abandoned in favor of application Ser. No. 10/954,938.

BACKGROUND OF THE INVENTION

1. Field of the Invention

The present invention relates to appliance securing members and more particularly pertains to a new appliance securing member for selectively securing an appliance to a wall, to prevent the tipping of the appliance.

2. Description of the Background Art

The use of appliance securing members is known in the art. U.S. Pat. No. 5,076,525 describes a pair of brackets, one attached to the appliance and one to a wall, which brackets are coupled together to prevent tipping of the appliance. U.S. Pat. No. 4,754,948 describes a bracket which is attached to an appliance, a wall and a floor. U.S. Pat. No. 4,890,813 includes a bracket which is attached to the floor for anchoring the rear feet of an oven.

While these devices do assist in the securing of an appliance to a surface, with the intent of securing the appliance in place, one skilled in the art will recognize that there remains a need for a securing device which permits more flexibility in the positioning of the appliance, and which provides better support when the appliance is a heavy appliance which is inclined to tip over. In addition, when there is a possibility of earthquake at the location where the appliance is being used, it becomes critical that the appliance securing device handle the load which may be applied to the securing device in the event of an earthquake.

The anti-tip devices described above are disabled if the appliance slides away from the wall approximately 2.5-3". This could easily occur in the event of an earthquake or if the range was moved accidentally, leaving the appliance vulnerable to a tip-over. Our device will not allow this to occur, unless it is manually released using the quick-release method during service, replacement or emergency removal.

SUMMARY OF THE INVENTION

The present device which is useful in securing an appliance in position against a supporting surface includes a plurality of brackets which are selectively positionable on an appliance, with a plurality of elongated members, each pivotally attached to a bracket, where each elongated member has at least one aperture spaced a distance along the length of the elongated member from the pivotal point with each bracket. The elongated member is then attached to a support surface, typically near the base of a wall, by attaching the elongated member to the support surface using a fastener which is retained in an aperture on the elongated member. Frequently, the elongated member is attached to the sole-plate, sometimes called a sill-plate or a bottom plate, which is the bottom horizontal supporting member of a wall or building to which the vertical members are attached. Sole-plates are usually composed of lumber and are anchored by a lag bolt or other device to the foundation wall. Typically the fastener is adhered to a sole-plate by a screw. In some instances there may be an anchor which has been inserted into the wall surface and the fastener is inserted into the anchor. Such wall anchors are commonly known in the art.

Each bracket includes a plate, with the plate having at least three apertures extending through the plate. The apertures are spaced from each other to form a generally triangular configuration, or another configuration providing stability at least equal to that provided by the triangular configuration. At least one elongated member is pivotally attached to each bracket. When the bracket includes apertures spaced from each other in a generally triangular formation, the elongated member is typically pivotally attached to the bracket at the apex of said generally triangular formation, with the base of the triangular formation being attached to the appliance at least two locations on the base of the triangular formation.

The use of an attachment arm, elongated member, which is pivotal with respect to the point of attachment to the appliance permits a degree of self adjustment of the appliance with respect to the point of attachment of the elongated member to the support surface. This self adjustment enables an easier installation at the time the appliance is attached to the wall. It is also helpful in providing stability in case of an earthquake or other shock to the appliance which might otherwise cause the appliance to tend to tip over. Further, the self adjustment feature of the attachment device makes it possible to adjust the height of the appliance using the leveling devices typically present at the base of the appliance subsequent to fastening of the appliance to the wall or other support structure, if necessary.

When the end of the elongated member of the appliance attachment device which is attached to the support structure is attached to a bottom plate or sole-plate at the wall base, the attachment of the plurality of brackets to the appliance is typically made at a height, measured from the bottom of the appliance, which ranges from about ¼ to about ½ of the height of the appliance. The attachment to the wall or through the wall into the bottom plate or sole-plate is then made at a location which is at a height which is relatively near the bottom of the appliance. This arrangement of attachment points relative to the appliance height transfers a load from the appliance through the bracket to the elongated member, and to the point of attachment at the wall, or bottom plate or sole-plate, in combination with the pivotal ability in a plane with respect to the brackets, directs the fastener in the wall or baseboard to move upward through the wall material or the bottom plate or sole plate, rather than to pull directly out in a direction perpendicular to the wall or wall baseboard. This significantly improves the probability that the appliance will not tip over when the appliance is subjected to a tipping force.

The brackets and elongated members may be made of any high strength material, including composite materials of the kind known in the construction industry in general. However, the brackets are typically formed of a rigid material having a high shear strength, such as a metallic material. The elongated members are typically formed of a high tensile strength material which is generally more flexible than the rigid material used to form the brackets. However, in some instances, where the appliance is particularly heavy, the elongated members may also be formed from a rigid high shear strength material.

The appliance securing device of the present invention generally allows for some movement in and out of the major plane of the bracket plate, but does not allow for movement along a length of the elongated members after attachment of the elongated members to the support surface.

In its most common form, the present invention generally comprises a pair of brackets and a plurality of securing members that are adapted for selectively attaching the brackets to a rear side of an appliance. Each bracket is attached to an elongated member having a first end and a second end. The first end of the elongated member is pivotally attached to one of the brackets. The second end of the elongated member is pivotally attached to a supporting structure such as a wall bottom plate or sole-plate via a fastener which passes through the second end of the elongated member. Typically the elongated member passes through an aperture which is spaced a nominal distance along the length of the elongated member in a direction away from the pivotal attachment point of the bracket.

In an advantageous embodiment of the invention, the pivotal attachment between the brackets and the first ends of the elongate members includes a quick-release mechanism, allowing the appliance to be detached from the wall without tools. In one embodiment, the quick-release mechanism consists of a pivotal attachment device, such as a spindle which passes through the elongate member, and a retaining pin. A cable is attached to the retaining pin, which passes through the pivotal attachment. Pulling-on the cable releases the retaining pin and frees the pivotal attachment device. This permits the elongate member to separate from the bracket on the appliance, and allows the appliance to be moved away from a surface to which it has been attached for stabilization.

The more important features of the inventive appliance attachment device have been outlined, rather broadly above, and a more detailed description of the device follows below, with the present contribution to the art being illustrated in the claims which are appended to this application.

BRIEF DESCRIPTION OF THE DRAWINGS

The details of the invention will become apparent when consideration is given to the detailed description which follows; such description makes reference to the annexed drawings wherein:

FIG. 4A shows a front view schematic assembly which includes a bracket 12 and an elongated member 22 which are part of an appliance stabilizing device, in combination with a quick release device 400, which includes a spindle 402, a retaining pin 404, and a washer 406

FIG. 4B shows a top view of the assembly shown in FIG. 4A

FIG. 4C shows a cross-sectional view of the assembly shown in FIG. 4A and illustrates the aperture 405 in spindle 402 through which retaining pin 404 passes

DESCRIPTION OF THE PREFERRED EMBODIMENT

Figure 1:
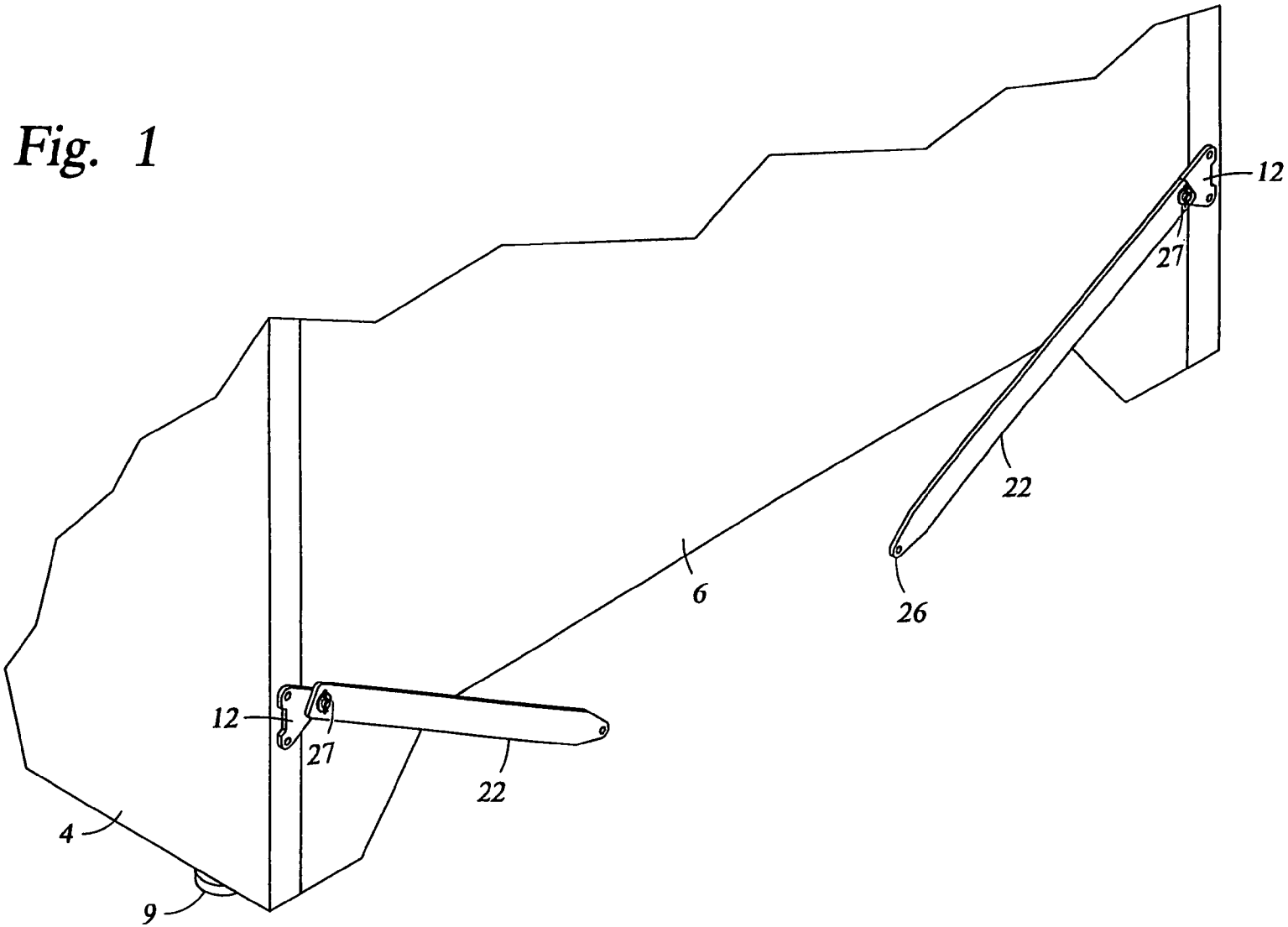
FIG. 1 is a schematic perspective view of an appliance stabilizing device a according to the present invention, illustrating a bracket 12 attached to an appliance, where bracket 12 is pivotally attached by a fastener/quick release device 27 to an elongated member 22 which is used to attach the appliance to a support structure.

With reference now to the drawings, and in particular to FIGS. 1 through 8, a new appliance securing member embodying the principles and concepts of the present invention and generally designated by the reference numeral 10 will be described.

Figure 2:
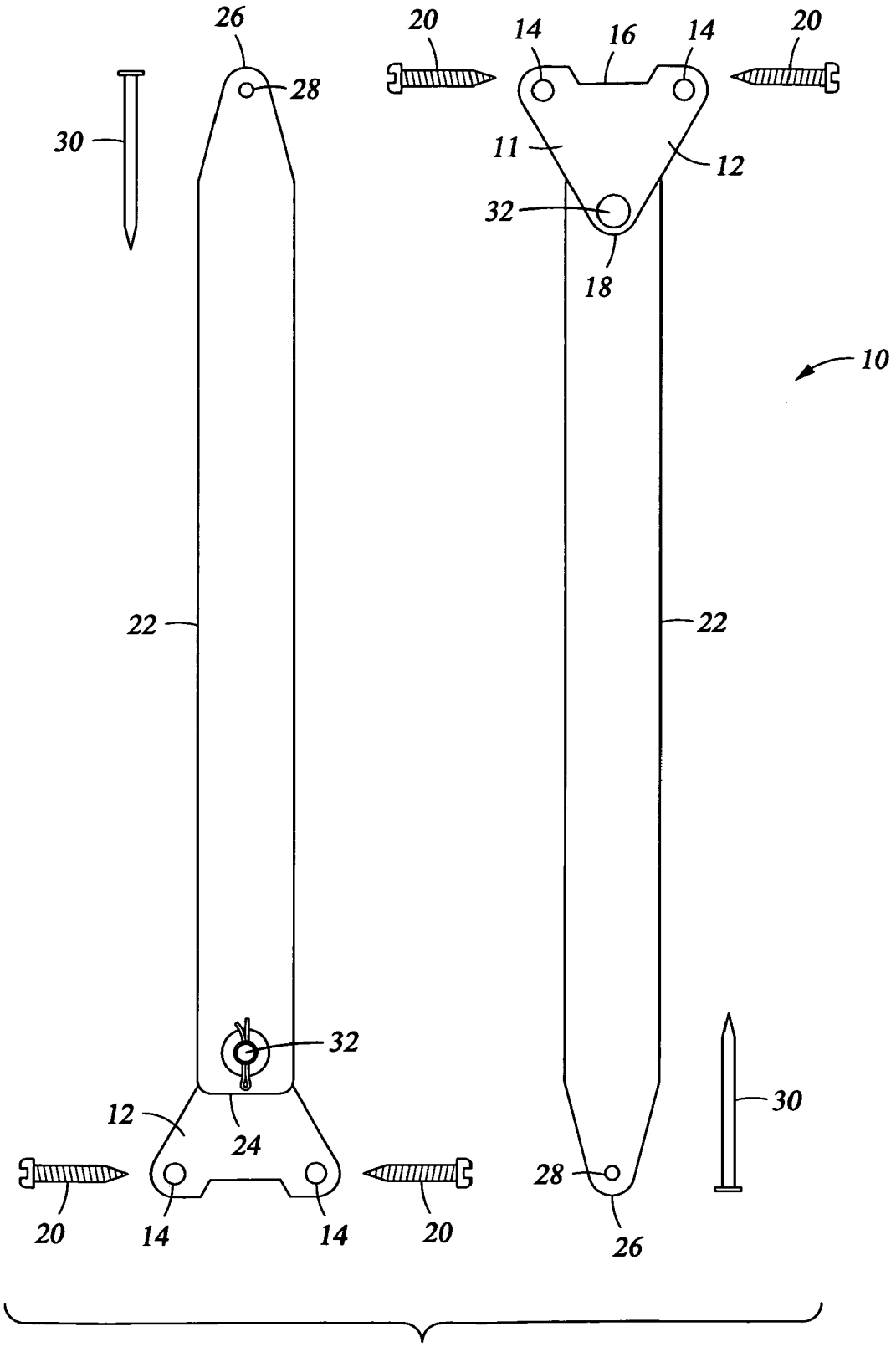
FIG. 2 is a schematic plan view illustrating elongated members 22 and a bracket 12 in more detail, including exemplary means for attachment of bracket 12 to elongated member 22 through fastener 32
Figure 3:
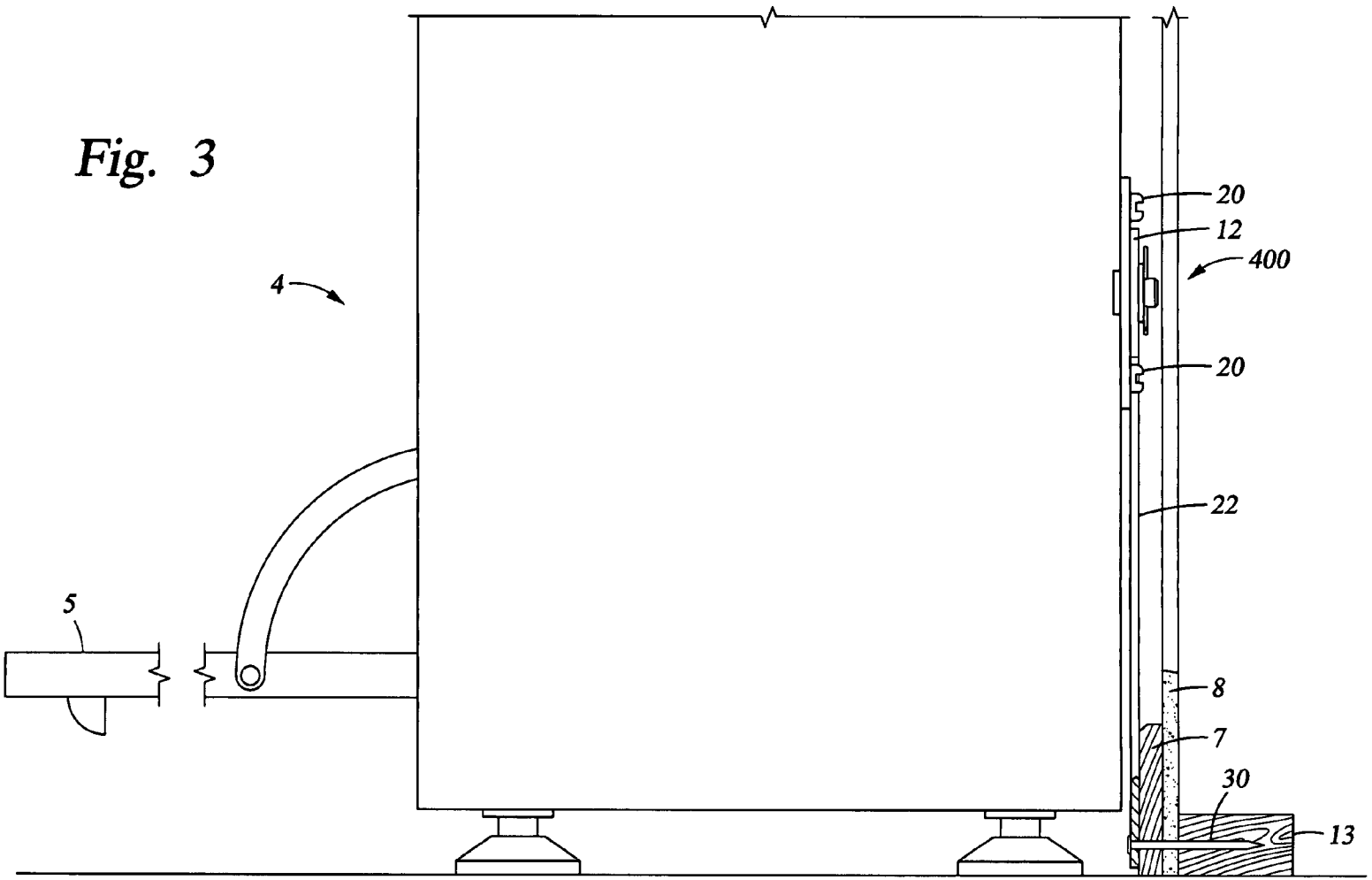
FIG. 3 is a schematic side in-use view of the present invention, where the appliance attachment device is attached to appliance 4 by securing members 20 which affix bracket 12 to appliance 4, where elongated member 22 is pivotally attached to bracket 12, and where elongated member 22 is attached through a baseboard 7, a wall structure 8, and a wall plate 13, by fastener 30, which is typically threaded, as shown.

As best illustrated in FIGS. 1 through 3, the appliance stabilizing device 10 generally comprises at least two brackets 12. Each of the brackets includes a plate 11. The plate 11 of bracket 12 has at least three apertures 14 extending therethrough. The apertures 14 are spaced from each other to form a generally triangular configuration, or another configuration providing stability at least equal to that provided by the triangular configuration. One skilled in the art can envision a number of stable configurations, but a triangular configuration of the kind shown in FIGS. 1 and 2 is the simplest stable design. The plates 11 shown in FIGS. 1 and 2 are also triangular in configuration, but it is obvious to one of skill in the art that it is not necessary to have a triangular plate to have the stable attachment which is provided by the triangular configuration of the apertures. For example, the plate 11 of bracket 12 could have a generally rectangular shape while having apertures positioned in a triangular configuration. The bracket 12 is positioned relative to the appliance so that the base 16 is attached to a rigid portion of the appliance, while the portion 18 of the bracket 12 to which the elongated members 22 is pivotally attached contains the aperture which forms the apex of the triangular configuration of apertures. The apertures 14 of base 16 are preferably positioned generally adjacent an edge of the base 16.

The brackets 12 are typically, but not by way of limitation, formed from a steel plate which ranges in thickness from about 16 gauge, U.S. Standard, (about 1/16 inch) to about 3 gauge, U.S. Standard, (about 1/4 inch), more typically, the bracket thickness ranges from about 16 gauge to about 11 gauge (about 1/8 inch). The elongated members are typically, but not by way of limitation, constructed from metal straps, or strips, such as steel strips, where the strapping ranges in thickness from about 22 gauge, U.S. Standard (about 0.031 inches) to about 11 gauge, U.S. Standard (about 1/8 inch), depending on the weight of the appliance.

Each of a plurality of securing members 20 is adapted for selectively attaching the brackets 12 to a rear side 6 of an appliance 4. The securing members 20 each typically, but not by way of limitation, comprise a threaded member, such as a bolt or screw, which is extendable through one of the apertures 14 and into the appliance 4. Alternatively, clamps or other mechanical fasteners may also be utilized.

Each of (frequently a pair of) the of elongated members 22 has a first end 24 and a second end 26. The first end 24 is pivotally attached to one of the brackets 12 through a fastener which acts as part of a quick release mechanism as described subsequently herein with reference to FIGS. 4A-4C. In FIG. 1 the fastener is shown as element 27; in FIG. 2, the fastener is shown as element 32; and, in FIG. 3, the fastener is shown as quick release device 400. The fastener 32 may be a bolt or a spindle which allows pivotal movement of elongated member 12 in relation to bracket 22. The elongated members 22 each have at least one opening 28 extending therethrough. The opening 28 is positioned generally adjacent to the second end 26 of the elongated member 22. One skilled in the art will recognize that a series of separate openings may be present extending in a lengthwise direction of the elongated member 22 toward the second end 26 of the elongated member, so that one length of elongated member may be used for more applications. The first ends 24 are preferably positioned to work in combination with the plate 11 of bracket 12, so that the elongated member 22 can pivot in a plane which is parallel with the plane of the major surface of bracket 12. As previously described, the plate 11 of bracket 12 is ideally comprised of a metallic material. Each of the elongate members 22 preferably lies in a plane which is co-planar with an attached one of said plates 11.

At least one fastener 30 is removably extendable through one of the at least one openings present near the second end 26 of elongated member 22, for selectively attaching elongated member 22 to a wall 8, in a manner similar to that shown in FIG. 3. As illustrated in FIG. 3, in some instances the fastener 30 may pass through a baseboard 7, into a general wall structure 8 (such as a dry wall structure), and further into a wall bottom plate or sole-plate 13 which lies behind the general wall structure 8. This adds additional strength to the attachment. In other instances, the fastener 30 may pass through a general wall structure 8 and into a wall bottom plate or sole-plate 13. In other instances, depending on where the elongated member 22 is attached to a general wall structure 8, a baseboard 7 and a wall plate 13 may not be present and an insert (not shown) may be used in the general wall structure 8 to provide additional strength for the attachment of fastener 30 which passes through at least a portion of the insert.

In use, the brackets 12 are typically attached to the appliance 4, such as an oven, on either side edge of a rear portion 6 of the oven, as shown in FIG. 1. The elongated members 22 are positioned so that their second ends 26 are adjacent to a wall structure 8, and possibly a baseboard 7, and a wall plate 13, as illustrated in FIG. 3. The fasteners 30 preferably include a threaded configuration to provide more surface area for attachment and to provide better contact with a baseboard 7, wall structure 8, and wall plate 13. As previously mentioned, an insert (not shown) may be used in a wall structure 8, with a fastener inserted into the insert present in wall structure 8.

With reference to FIG. 3, the attachment to the wall structure is then made at a location which is at a height which is relatively near the bottom of the appliance. When there is an event which might cause the appliance to tip away from wall structure 8, a load is transferred from the appliance 4 through the bracket 12 to the elongated member 11, and to the point of attachment of fastener 30 at the wall structure 8 (and possibly through a baseboard 7 and/or a wall bottom plate or sole-plate 13. The appliance stabilizing device of the present invention directs the fastener 30 in the wall structure 8 (and possibly baseboard 7 and/or wall bottom plate or sole-plate 13 ) to move upward through the wall structure 8 material (and possibly baseboard 7 and/or wall plate 13) material, rather than to pull directly out in a direction perpendicular to the wall or wall baseboard. When compared to prior designs for devices used to attach an appliance to a wall, the present design significantly improves the probability that the appliance will not tip over when the appliance is subjected to a tipping force.

The device 10 prevents the tipping of the appliance 4, such as when the door 5 of an oven is opened, as illustrated in FIG. 3, and stepped upon by a child, by way of example. The brackets 12 may be positioned so that the elongate members 22 are selectively positioned against the wall structure 8. The elongate members 22 are pivotally attached to the brackets 12 to further aid in the placement of the second ends 26, to permit limited movement during an earthquake in a manner which helps stabilize the appliance in combination with the wall structure, and to permit leveling of the appliance using the leveling feet 9 of the kind shown in FIG. 1, which leveling feet 9 are commonly known within the appliance industry.

An alternate embodiment of the invention is shown in FIGS. 4A-4C. FIG. 4A shows the front view schematic of an assembly which shows a quick release mechanism 400, located at the pivotal attachment of the first end of the elongate member 22 to the bracket 12. A quick-release mechanism is a desirable feature allowing the removal of the appliance without the use of tools. In this embodiment, the quick-release mechanism consists of a spindle 402 connecting the apex aperture of the triangular bracket 12 to the aperture in the first end of elongate member 22, which is fastened by retaining pin 404, passing through aperture 405 in the spindle, as shown in the top view of assembly 400 in FIG. 4B. Aperture 405 is illustrated in the cross-sectional view of FIG. 4C and is positioned in a perpendicular direction to the long axis of spindle 402. Washer 406 is positioned between the retaining pin and elongate member 22. Spindle 402 passes through washer 406. This washer acts to reduce the shearing forces experienced by the retaining pin. One embodiment of the retaining pin is a cotter pin 404, such as the one shown in FIG. 4. It must be appreciated that this is simply one possible embodiment of the retaining pin. The cotter pin consists of two tines, both of which slide through aperture 405 in the spindle, and one of the tines is slightly bent during installation to keep the cotter pin in place. Removal of the cotter pin by applying a pulling force removes the mechanical barrier keeping the spindle, the washer, and the elongate member in place, thus allowing the spindle to slide out once a force is applied in the direction of the longitudinal axis of the spindle, thereby disconnecting triangular bracket 12 from elongate member 22. The direction of the longitudinal axis of the spindle is the same direction as that which moves the appliance away from the wall. The retaining pin 404 may be coated with an appropriate lubricant (not shown) to allow less friction upon removal of the retaining pin. One skilled in the art would know how to select the appropriate lubricant.

Figure 5:
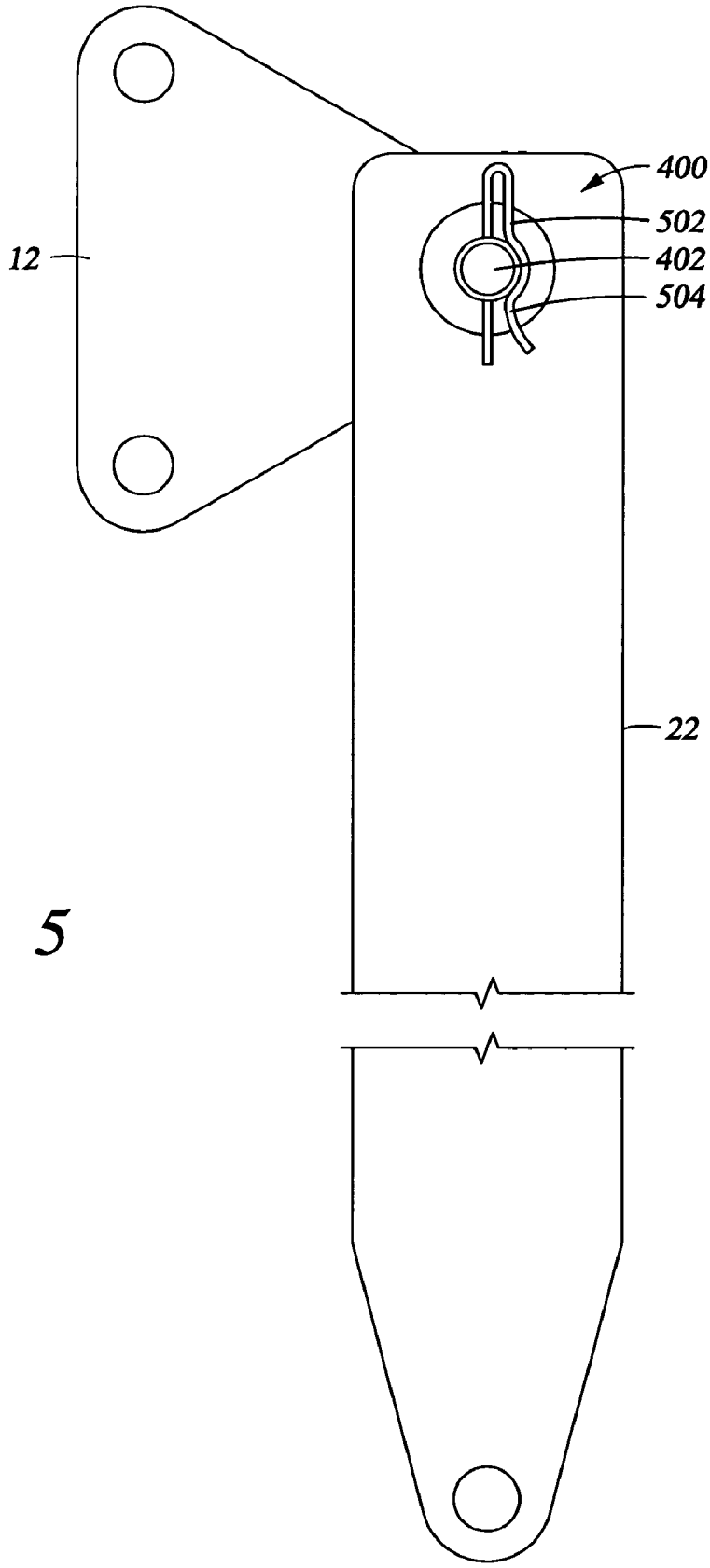
FIG. 5 is a schematic plan of an alternate embodiment of the quick-release mechanism 400 of the present invention

FIG. 5 illustrates another embodiment of the retaining pin of the quick-release mechanism 400. In this embodiment, a spring clip 502 is used. Spring clip 502 has only one tine going through the aperture in spindle 402, the other tine 504 is bent into shape around the outside of the spindle. This arrangement allows for less force needed to release the spring clip from the spindle.

It is imperative that the right material be used for the quick-release, both for the spindle as well as the retaining pin. The retaining pin needs to have high tensile strength and high toughness, to prevent deformation or fracture which would lead to failure of the stabilizing device and the appliance becoming detached from the wall. The preferred material is metal. Metals which have the requisite tensile strength and toughness include, for example and not by way of limitation, high strength steel alloys, aluminum alloys, and titanium alloys. High strengths steels with the suitable tensile strength and toughness include ASTM A514 steel and ASTMA228 steel, the latter being known as "spring steel" or "music wire". The spindle requires high tensile strength and toughness as well, as well as high shear strength. In addition the spindle needs to have low surface friction, to ease the pivotal movement of elongate member 22. The spindle can be a metal, such as the metal used for the retaining pin, and may have a lubricated surface. The spindle may be metal, with an appropriate lubricant (not shown) applied over the exterior bearing surface. In an alternative embodiment, the spindle may be a metal with a sleeve over the bearing surface, where the sleeve is an engineering plastic such as, for example and not by way of limitation, Teflon, nylon, polyimide, polysulfide, polycarbonate, polybutylene terephthalate. A metal spindle with a plastic sleeve would have the requisite shear strength along with low surface friction. Washer 406 can be a metal or an engineering plastic, such as the one used for the spindle.

In an alternative embodiment, spindle 402 can be spot-welded (not shown) to the exterior surface 403 of bracket 12. The spindle and the bracket thus become one piece around which the elongate member pivots. In this embodiment, a retaining pin may still be utilized for a quick-release mechanism.

The selection of the material for the retaining pin as well as the angle to which the cotter pin, in the embodiment of FIG. 4, is bent depend on the application at hand. For example, an appliance such as a washing machine, which is subject to continuous vibration, or a refrigerator, which experiences frequent opening and closing of the door, would require a material with a higher tensile strength and shear strength, and lower ductility, to prevent failure of the pin. The angle of the bend in the cotter pin would need to be greater as well, to prevent the pin from sliding out during routine use of the appliance. An appliance such a stove, which does not experience such forces frequently, would have less stringent requirements. The angle of the bend in the cotter pin also determines the pulling force required to release the pin, and one of ordinary skill in the art can calculate how much of a bend would be required upon installation for a desired pulling force needed to free the pin.

Figure 6A:
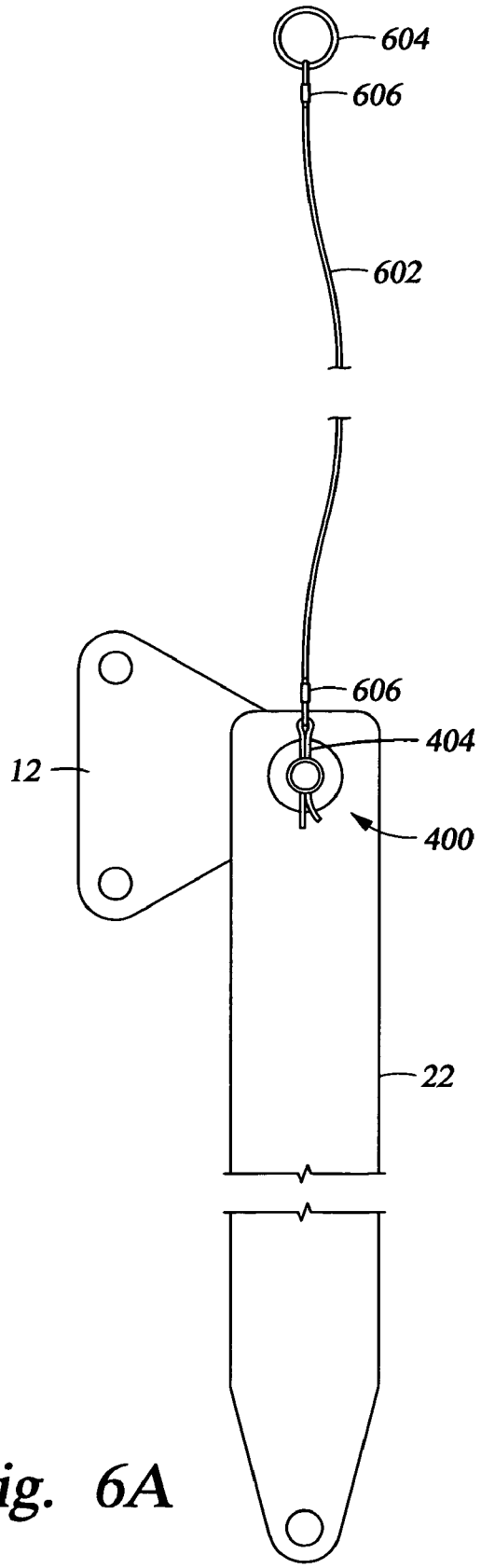
FIG. 6A is a front view of an assembly including the quick-release mechanism 400 illustrated in FIGS. 4A through 4C, where a flexible cable 602 is attached to retaining pin 404 by a fastening device 606. Flexible cable 602 is attached to a ring 604 through fastening device 606 and can be pulled during a release process
Figure 6B:
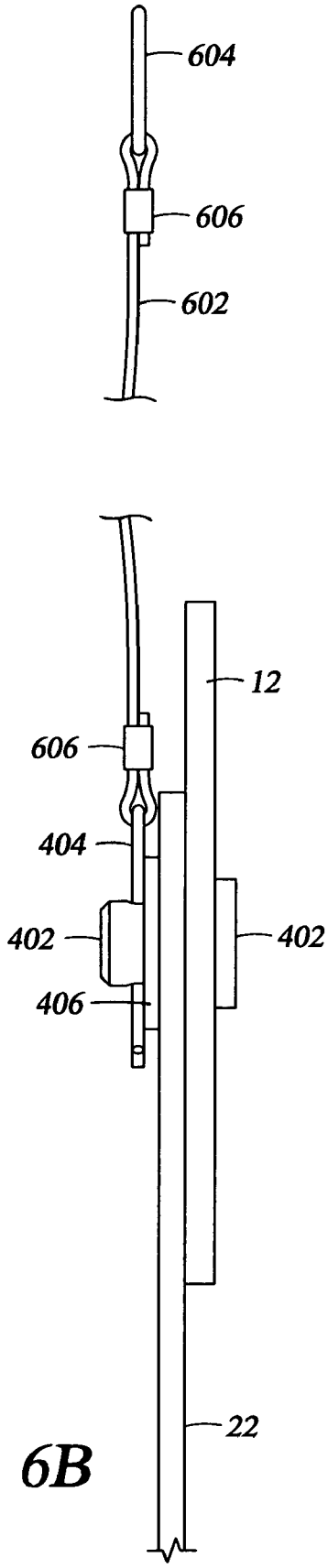
FIG. 6B is a side view of the assembly shown in FIG. 6A

FIGS. 6A and 6B show one embodiment of the mechanism by which the pulling force may be applied to the retaining pin. The front view schematic of FIG. 6A shows that one end of flexible cable 602 is attached to retaining pin 404. The other end of flexible cable 602 is attached to ring 604 with fastener 606, seen in the side view schematic of FIG. 6B. The fastener 606 can be a crimped sleeve, made, for example and not by way of limitation, from aluminum or an aluminum alloy, which is designed to frictionally engage the flexible cable. The ring may be fastened to the top of the appliance in the back, where it may be grasped by reaching over the top of the appliance. The ring may be attached to the appliance itself or to the wall. It may be attached through any known means in the art, such as by hanging it on a hook, or through tape or Velcro. By reaching over the appliance, one may grasp the ring and pull it, thereby releasing the retaining pin and thus releasing the appliance. In this embodiment, the retaining pins face upward, meaning that the tine is bent on the bottom. This allows the pins to be released by applying a pulling force from the top. The cable may be made from any sufficiently strong and flexible material, such as a metal wire, polymer fibers, or composites or combinations of the two.

Figure 7:
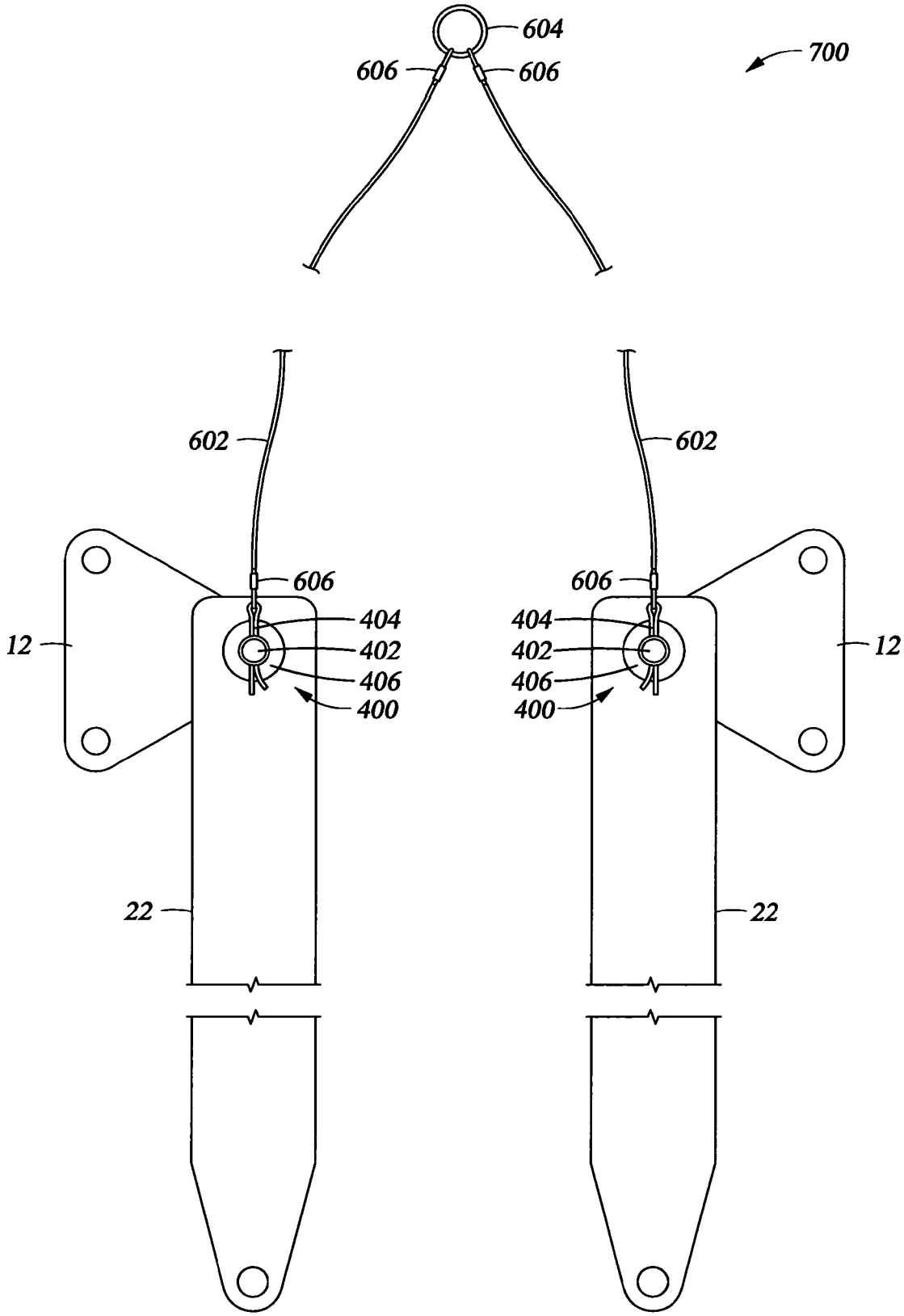
FIG. 7 shows a front view schematic of an entire assembly 700 which includes the appliance stabilizing device of the invention in combination with the quick-release device shown in FIGS. 4A-4C, 5, and 6A-6B

FIG. 7 shows a front view schematic of an entire assembly 700, which includes the appliance stabilizing device of the invention in combination with the quick-release device shown in FIGS. 4A-4C, 5, and 6A-6C. As is shown, preferably, ring 604 is attached to two cables 602, each going to one of retaining pins 404 on one side of the appliance stabilizing device. Therefore, by pulling on the ring, both retaining pins 404 are released at the same time, thus allowing the appliance to be moved away from the wall to which it has been attached for stabilization.

Figure 8A:
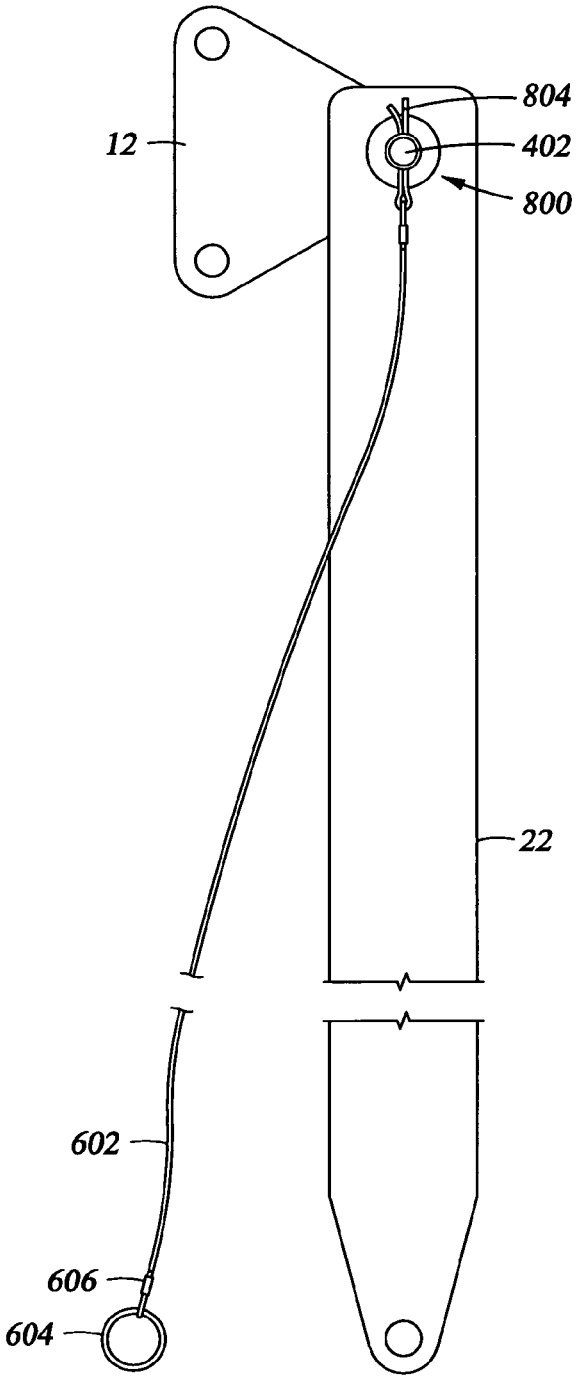
FIG. 8A shows a front view schematic of an alternative embodiment of a quick-release mechanism 800, where the retaining pin 804 is designed for quick-release of an appliance stabilizing device from the bottom area of an appliance (not shown)
Figure 8B:
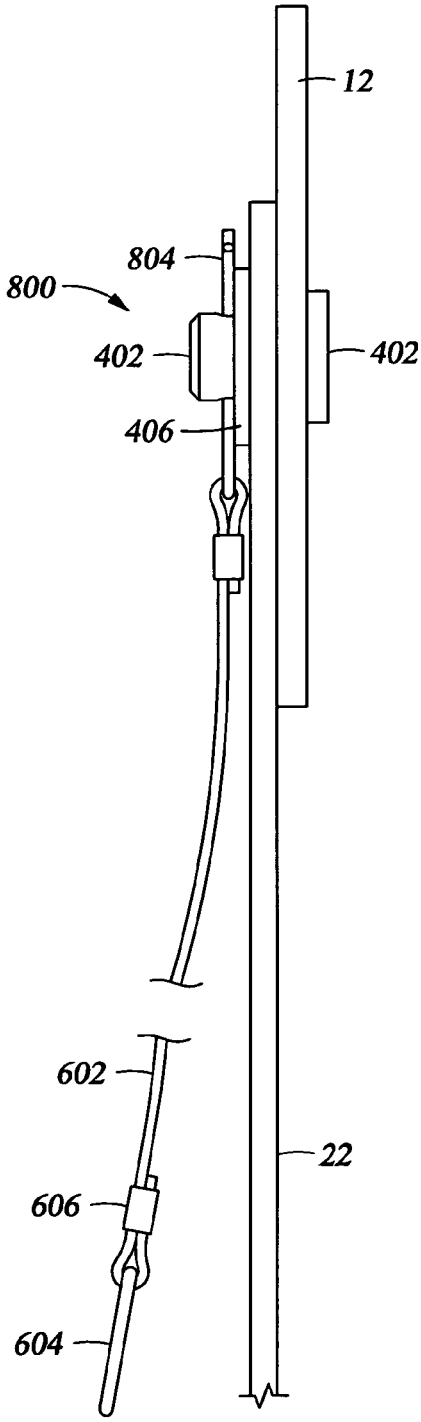
FIG. 8B is a side view schematic of the alternative quick-release mechanism 800 shown in FIG. 8A

An alternate embodiment of the invention includes a quick-release mechanism, wherein the retaining pins face downward, meaning the bend in the tine is on the top of the mechanism. This is illustrated in FIGS. 8A and 8B. FIG. 8A shows the front view schematic of a quick-release mechanism 800, where retaining pin 804 is positioned downward, and cable 602 leads down to the bottom of the appliance (not shown) where ring 604, secured to cable 602 with fastener 606, is attached. As can be seen in the side view schematic of FIG. 8B, pulling downward on cable 602 removes retaining pin 804, thereby freeing up spindle 402. In some applications, it is preferable that the quick-release mechanism be activated from the bottom of the appliance by applying the pulling force from there.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An appliance stabilizing device for removably securing an appliance to a wall or other supporting structure, said stabilizing device including a quick release mechanism, said stabilizing device comprising:

at least two brackets, each of said brackets including a plate, each of said plates having at least three apertures extending therethrough, said apertures being spaced from each other to form a generally triangular configuration or another configuration providing stability at least equal to that provided by said triangular configuration;

a plurality of securing members, each securing member being adapted for selectively attaching a bracket to a rear side of an appliance, each of said securing members comprising a member which is extendable through one of said apertures in said bracket and into said rear side of said appliance, where at least two of said securing members are used to attach a bracket to said appliance;

at least two elongated members having a first end and a second end, each of said first ends being pivotally attached to a bracket plate by a spindle extending from or through said bracket plate; wherein a pivotal attachment device is located at an apex of a generally triangular configuration of apertures in said bracket plate, with the base of said triangular configuration being attached to said rear side of said appliance, and wherein a quick release mechanism is present at each pivotal attachment device; or, wherein said pivotal attachment device is located at a said another configuration which provides at least equivalent stability to that of a triangular configuration, with a quick release mechanism present at each pivotal attachment device; and, where said second end of said elongated member has at least one opening therethrough to facilitate attachment of said elongated member to a wall or other supporting structure;

at least two fasteners, each of said fasteners being removably extendable through one of said openings in said elongated member and into said wall or other supporting structure for selectively attaching said elongated member to said wall or other supporting structure, and wherein said quick release mechanism permits release of said appliance from elongated members of said appliance stabilization device without the use of a tool.

2. An apparatus in accordance with claim 1, wherein said plates of said brackets have three apertures extending therethrough and wherein said apertures form a triangular shape relative to each other.

3. An apparatus in accordance with claim 1, where said securing member is a threaded member.

4. An apparatus in accordance with claim 1, wherein said elongated members are formed from a metallic material which permits some movement into and out of a plane on which a bracket is mounted, but does not allow for movement along a length of an elongated member.

5. An appliance stabilizing device in accordance with claim 1, wherein said quick-release mechanism includes a spindle which acts as said pivotal attachment device and which permits said appliance to be separated from said elongated members, which are attached to said wall or other support structure, without the use of a tool.

6. An apparatus in accordance with claim 1, wherein said quick-release mechanism comprises a retaining pin passing through an aperture in each spindle.

7. An apparatus in accordance with claim 5 or claim 6, wherein said quick-release mechanism further comprises a first cable having a first cable end and a second cable end, said first cable end of the said cable being attached to one of said retaining pins and said second cable end being attached to a ring for grasping.

8. An apparatus in accordance with claim 7, further comprising a second cable having a first cable end and a second cable end, said first cable end of said second cable being attached to another of said retaining pins, and wherein said second end of said second cable is attached to the same ring which is attached to said second cable end of said first cable.

9. The apparatus in accordance with claim 8, wherein said retaining pins are releasably positioned within an aperture in said spindle such that said retaining pin can be released from a position above said spindle or below said spindle.

10. An apparatus in accordance with claim 6, wherein said retaining pin is selected from the group consisting of a cotter pin and a spring clip.

11. An apparatus in accordance with claim 6 or claim 10, wherein said retaining pin comprises a metal.

12. An apparatus in accordance with claim 11, wherein said metal is selected from the group comprising a high carbon steel, an aluminum alloy, and a titanium alloy.

13. An apparatus in accordance with claim 12, wherein said high carbon steel is selected from the group comprising ASTM A228 steel and ASTM A514 steel.

14. An apparatus in accordance with claim 1, wherein said spindle comprises a metal.

15. An apparatus in accordance with claim 14, wherein said spindle further comprises a sleeve, with said sleeve comprising an engineering plastic.

16. An apparatus in accordance with claim 15, wherein said engineering plastic is selected from the group consisting of Teflon, nylon, polyimide, polysulfide, polycarbonate, polybutylene terephthalate.

17. An apparatus in accordance with claim 1, wherein said pivotal attachment device is a spindle which is spot-welded to an exterior surface of said bracket plate.

* * * * *